US010829288B2

(12) United States Patent
Farstad et al.

(10) Patent No.: US 10,829,288 B2
(45) Date of Patent: Nov. 10, 2020

(54) RIGID PACKAGING WITH A STRAINING FEATURE

(71) Applicant: Dow Global Technologies LLC, Midland, MI (US)

(72) Inventors: Andre Farstad, Savannah, GA (US); Maria Isabel Arroyo Villan, Tarragona (ES); Marcelo Tognola, Tarragona (ES)

(73) Assignee: Dow Global Technologies LLC, Midland, MI (US)

( * ) Notice: Subject to any disclaimer, the term of this patent is extended or adjusted under 35 U.S.C. 154(b) by 253 days.

(21) Appl. No.: 16/064,736

(22) PCT Filed: Dec. 15, 2016

(86) PCT No.: PCT/US2016/066838
§ 371 (c)(1),
(2) Date: Jun. 21, 2018

(87) PCT Pub. No.: WO2017/112512
PCT Pub. Date: Jun. 29, 2017

(65) Prior Publication Data

US 2018/0370705 A1 Dec. 27, 2018

(30) Foreign Application Priority Data

Dec. 21, 2015 (EP) ..... 15382653

(51) Int. Cl.
*B65D 77/20* (2006.01)
*B65D 75/32* (2006.01)
*B65D 53/08* (2006.01)

(52) U.S. Cl.
CPC ..... *B65D 77/2032* (2013.01); *B65D 53/08* (2013.01); *B65D 75/326* (2013.01); *B65D 2575/36* (2013.01)

(58) Field of Classification Search
CPC ..... B65D 77/206; B65D 77/30; B65D 77/36; B65D 47/185
(Continued)

(56) References Cited

U.S. PATENT DOCUMENTS 4,960,216 A 10/1990 Giles et al.
5,246,106 A 9/1993 Johnson
(Continued)

FOREIGN PATENT DOCUMENTS

EP 471211 A1 7/1991
EP 0790193 A1 8/1997
(Continued)

OTHER PUBLICATIONS

European Extended Search Report pertaining to European Application No. 15382653.2 dated Jun. 1, 2016.
(Continued)

*Primary Examiner* — Jeffrey R Allen
(74) *Attorney, Agent, or Firm* — Dinsmore & Shohl LLP

(57) ABSTRACT

Container (1) having a container body (10) having a sealing lip (12). The container (1) comprises a bottom perforated film (20) adhered to the sealing lip (12) at a first adhesion strength (S1), a top film (30) adhered to the bottom perforated film (20) at a second adhesion strength (S2) at locations not vertically aligned with a seal end (38), and wherein the top film (30) adheres to the bottom perforated film (20) at a third adhesion strength (S3) at the seal end (38). The third adhesion strength (S3) is greater than the first adhesion strength (S1) which is greater than the second adhesion strength (S2), such that the top film (30) is peelable relative to the bottom perforated film (24) at the opening end (36), and the top film (30) is peelable with the bottom perforated film (20) relative to the container body (10) at the seal end (38).

16 Claims, 3 Drawing Sheets

(58) Field of Classification Search
USPC ..... 220/780, 787, 789
See application file for complete search history.

(56) References Cited

U.S. PATENT DOCUMENTS

| | | | | |
|---|---|---|---|---|
| 5,513,781 | A | 5/1996 | Ullrich et al. | |
| 5,709,479 | A | 1/1998 | Bell | |
| 5,776,284 | A | 7/1998 | Sykes et al. | |
| 5,785,428 | A | 7/1998 | Mazzocchi | |
| 5,914,142 | A | 6/1999 | Zartner | |
| 5,971,613 | A | 10/1999 | Bell | |
| 7,863,383 | B2 | 1/2011 | Gibbons et al. | |
| 2004/0013827 | A1* | 1/2004 | Zuser | B32B 7/06 428/34.1 |
| 2014/0370160 | A1 | 12/2014 | Martin et al. | |
| 2015/0158643 | A1 | 6/2015 | Coker et al. | |

FOREIGN PATENT DOCUMENTS

| | | | |
|---|---|---|---|
| EP | 1659074 | A1 | 5/2006 |
| FR | 2878143 | A1 | 5/2006 |
| JP | S57180678 | A | 11/1982 |
| JP | 2007028406 | A | 2/2007 |
| JP | 2010280422 | A | 12/2010 |
| JP | 2011011807 | A | 1/2011 |
| WO | 9639911 | A1 | 12/1996 |
| WO | 2007096930 | A1 | 8/2007 |
| WO | 2013143706 | A1 | 10/2013 |
| WO | 2014181129 | A1 | 11/2014 |

OTHER PUBLICATIONS

European Extended Search Report pertaining to European Application No. 15382652.4 dated Apr. 28, 2016.

International Search Report and Written Opinion pertaining to PCT/US2016/066838 dated Feb. 27, 2017.

International Search Report and Written Opinion pertaining to PCT/US2016/066819 dated Feb. 3, 2017.

Office Action pertaining to corresponding Chinese Patent Application No. 201680074734.1, dated Dec. 23, 2019.

Office Action pertaining to corresponding Chinese Patent Application No. 201680074734.1, dated Apr. 8, 2019.

* cited by examiner

RIGID PACKAGING WITH A STRAINING FEATURE

CROSS-REFERENCE TO RELATED APPLICATION

This application claims priority to European Patent Application No. 15382653.2 filed Dec. 21, 2015, which is incorporated by reference herein in its entirety.

TECHNICAL FIELD

Embodiments of the present disclosure generally relate to rigid product packaging. More specifically, embodiments of the present disclosure relate to rigid packages comprising a straining feature for products stored and transported in a preserving liquid or for dispensing a dry powdered or flaked product.

BACKGROUND

A variety of foodstuffs and other consumer goods are packaged for storage or transport in a fluid. For example, fresh mozzarella cheese and pickles are commonly packaged in a liquid to maintain their quality and characteristics between manufacture and consumption by the consumer. Additionally, ball bearings or other machined parts may be packaged and transported in a preserving fluid, such as oil or alcohol, to prevent oxidation or other detrimental changes before use and/or installation. A vast array of other fields utilize products which are similarly stored, transported, or packaged in a fluid which needs to be drained before utilization of the product.

The difficulty for the consumer with packaging where a solid product is contained in a liquid is that it can be difficult for the consumer to access the product without risking an accidental spill of the liquid, and/or the solid product. Conventional containers for packaging a solid product in a liquid may not attempt to provide a means for separation of the liquid and solid product. For example, a glass jar of pickles with a standard twist off cap necessitates reaching into the pickling solution with a finger or fork to retrieve a pickle. Other solutions which have attempted to solve this problem include utilization of a second removable container with draining capabilities nested within a main outer container. However, such dual container arrangements present a more costly and complicated manufacturing process.

Accordingly, there remains a need for a rigid package that facilitates consumer access to a solid product stored in a liquid while minimizing the risk of an accidental spill of the liquid and/or solid product.

SUMMARY

Embodiments of the present disclosure are directed to rigid packages with a perforated film that allows drainage of a liquid from a container while retaining the solid products therein. Embodiments of the present disclosure are also directed to rigid packages with a perforated film that allows dry powder or flaked products to be dispensed from the flexible package.

In accordance with one embodiment, a container is provided. The container comprises a container body having a sealing lip, wherein the sealing lip comprising an opening end and a seal end spaced from the opening end. The container also comprises a bottom perforated film comprising a first sealant layer and a first substrate layer, the first sealant layer being adhered to the sealing lip at a first adhesion strength, and also comprises a top film adhered to the bottom perforated film, and comprising a second sealant layer and a second substrate layer, wherein the top film adheres to the bottom perforated film at a second adhesion strength at one or more locations not in vertical alignment with the seal end, and wherein the top film adheres to the bottom perforated film at a third adhesion strength at a location in vertical alignment with the seal end. The third adhesion strength is greater than the first adhesion strength which is greater than the second adhesion strength, such that, upon application of a pull force, the top film is peelable relative to the bottom perforated film at the opening end and the top film is peelable with the bottom perforated film relative to the container body at the seal end.

In another container embodiment, the container comprises a container body having a sealing lip, the sealing lip comprising an opening end and a seal end, and also comprises a bottom perforated film comprising a first sealant layer and a first substrate layer, the first sealant layer being adhered to the sealing lip at a first adhesion strength. The container further comprises a top film adhered to the bottom perforated film, the top film comprising a second sealant layer and a second substrate layer, wherein the top film adheres to the bottom perforated film at a second adhesion strength. The first adhesion strength is greater than the second adhesion strength, such that, upon application of pull force to the top film at the opening end, the top film is peelable relative to the bottom perforated film and, upon application of pull force to the bottom perforated film at the seal end, the bottom perforated film is peelable relative to the container body.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosure can be best understood when read in conjunction with the drawings enclosed herewith.

Figure 1:
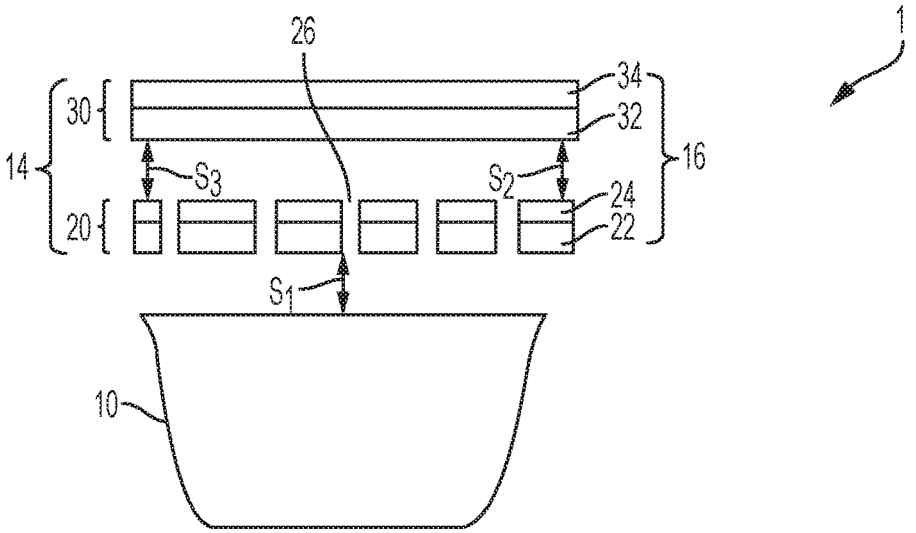
FIG. 1 is an exploded view of a container according to one or more embodiments of the present disclosure.

The embodiments set forth in the drawings are illustrative in nature and not intended to be limiting to the claims. Moreover, individual features of the drawings will be more fully apparent and understood in view of the detailed description.

DETAILED DESCRIPTION

Referring to FIG. 1, an embodiment of a container 1 is shown. The depicted containers are circular cups; however, various additional container types and shapes are contemplated herein. The container 1 includes a container body 10, a bottom perforated film 20 adhered to the container body 10 and a top film 30 adhered to the bottom perforated film 20. The exploded schematic view of FIG. 1 depicts the location and relationship of the multiple components of the container 1. The top film 30 and the bottom perforated film 20 are intentionally enlarged in FIG. 1 (i.e., not drawn to scale) for purposes of illustrating one or more features of the present disclosure and should not be construed as narrowing the scope based on scale.

Figure 2:
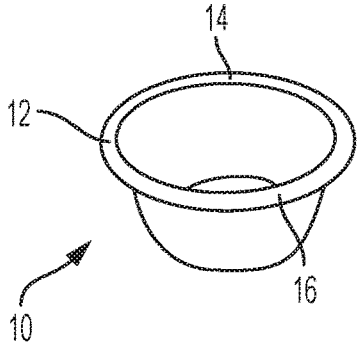
FIG. 2 is a perspective view of a container body according to one or more embodiments of the present disclosure.

With reference to FIG. 2, the container body 10 has a sealing lip 12 disposed around the periphery of a top edge of the container body 10. In one or more embodiments, the sealing lip 12 includes a seal end 14 and an opening end 16. The seal end 14 is spaced from the opening end 16, for example, in opposite sides of the sealing lip 12. The seal end 14 and the opening end 16 may define portions along the sealing lip 12. In embodiments where tabs are included in the container 1, as described below, the seal end 14 and the opening end 16 may encompass the regions of the sealing lip 12 in vertical alignment with tabs for removal of the bottom perforated film 20 and the top film 30, respectively, from the container body 10.

Various materials are contemplated for the container body 10. In one or more embodiments, the container body 10 comprises a polymeric material; for example, polyolefins, polyethylene terephthalate (PET), polystyrene (PS), or combinations thereof. The polyolefins may include polyethylene (PE), polypropylene (PP), or combinations thereof. In one or more embodiments, the container body 10 is a multilayer construction. For example, the container body 10 may be PS/ethylene vinyl acetate (EVA)/PE or PET/Tie layer/PE with the PE representing the inner layer and the PS or PET representing the outer layer.

With reference to FIG. 1, the bottom perforated film 20 and the top film 30 are multilayer films; however, it is also contemplated that the bottom perforated film 20, the top film 30, or both may be monolayer films. While the multilayer films discussed herein have two layers, it is contemplated that more than two layers may be used for the bottom perforated film 20 and the top film 30. In one or more embodiments, the multilayer structure of the bottom perforated film 20 and the top film 30 may each comprise a sealant layer to form a seal with adjoining media and a substrate layer to provide desired structural, environmental, or other material properties. The bottom perforated film 20 may have a first sealant layer 22 and a first substrate layer 24. As shown in FIG. 1, the first sealant layer 22 of the bottom perforated film 20 adheres to the sealing lip 12 at a first adhesion strength $S_1$. Similarly, the top film 30 has a second sealant layer 32 and a second substrate layer 34. The second sealant layer 32 of the top film 30 adheres to the bottom perforated film 20 at a second adhesion strength $S_2$ at one or more locations not in vertical alignment with the seal end 14. The second sealant layer 32 of the top film 30 may also adhere to the bottom perforated film 20 at a third adhesion strength $S_3$ at a location in vertical alignment with the seal end 14. As described subsequently, the adhesion of the top film 30 and the bottom perforated film 20 have varying seal strengths across the interface of the top film 30 and the bottom perforated film 20 to produce the desired peeling. Moreover, in one or more embodiments, the top film 30 adheres to the bottom perforated film 20 at the second adhesion strength $S_2$ only at locations in alignment with the sealing lip 12. In further embodiments, the top film 30 adheres to the bottom perforated film 20 across the entirety of the bottom perforated film 20.

Figure 3:
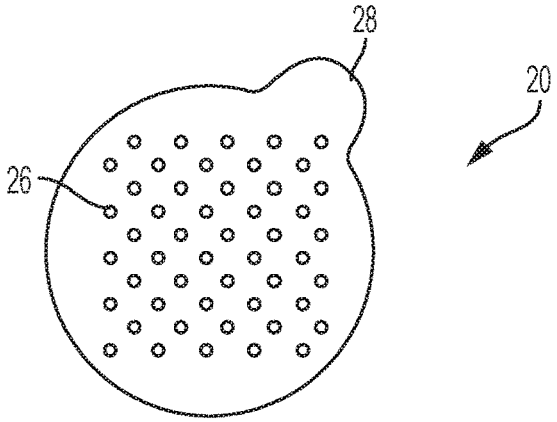
FIG. 3 is a schematic view of a bottom perforated film according to one or more embodiments of the present disclosure.

With reference to the embodiment of FIG. 3, the bottom perforated film 20 may include a bottom seal tab 28. When the bottom perforated film 20 is adhered to the sealing lip 12 of the container body 10, the bottom seal tab 28 extends beyond the sealing lip 12 at the seal end 14. The bottom seal tab 28 provides a point for application of a pull force to remove the bottom perforated film 20 from the container body 10. In various embodiments, the bottom seal tab 28 may be a semicircular extension (as shown in FIG. 3), a strip, or simply excess film created by sizing the bottom perforated film 20 larger than the outer dimensions of the sealing lip 12.

As stated above, the bottom perforated film 20 includes perforations 26, which are configured to allow drainage of a fluid or dispensing of a powder or flaked product from the interior of the container body 10. The perforations 26 may include various hole shapes, sizes and arrangements. In one or more embodiments, the perforations 26 are circular or elliptical. In various other embodiments, the perforations 26 are slots, square, rectangular, or combinations of multiple shapes. The perforations 26 may be organized into specific shapes or designs, for example, perforations shaped substantially like letters to spell a word or product name of the contents of the container 1. In one or more embodiments, the perforations 26 are spaced evenly across the bottom perforated film 20. Spacing perforations 26 across the entire bottom perforated film 20 allows for quick drainage of the container 1. In further embodiments, the perforations 26 are located in only a portion of the bottom perforated film 20. Locating perforations 26 in only a portion of the bottom perforated film 20 allows the container 1 to be slowly drained in a controlled manner or for powder or flaked product to be dispensed from a particular corner or region in relation to the container body 10. The spacing between perforations 26 may vary depending on the volume of fluid to be drained from the container 1, the size of the individual perforations 26, the desired dispensing rate of a powder or flaked product, or other factors. In various embodiments, the bottom perforated film 20 has 1 to 100 perforations, or 4 to 75 perforations, or 10 to 50 perforations, or 20 to 30 perforations. One skilled in the art will appreciate that the total number of perforations desired may vary depending on the total size of the bottom perforated film 20, the size of the individual perforations 26, and the desired rate of fluid drainage or dispensing rate of a powder or flaked product.

Figure 4:
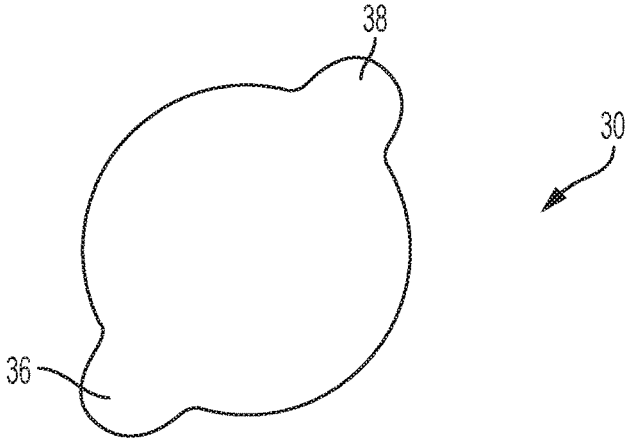
FIG. 4 is a schematic view of a top film according to one or more embodiments of the present disclosure.

With reference to the embodiment of FIG. 4, the top film 30 may include a top opening tab 36. When the top film 30 is adhered to the bottom perforated film 20, which is adhered to the sealing lip 12 of the container body 10, the top opening tab 36 extends beyond the sealing lip 12 at the opening end 16. In various embodiments, the top opening tab 36 may be a semicircular extension (as shown in FIG. 4), a strip, or simply excess film created by sizing the bottom perforated film 20 larger than the outer dimensions of the sealing lip 12. In one or more embodiments, the top film 30 also includes a top seal tab 38 extending beyond the sealing lip 12 at the seal end 14. When the top film 30 is adhered to the bottom perforated film 20, the top seal tab 38 is in alignment with the bottom seal tab 28. Referring to FIG. 1, the top seal tab 38 may be adhered to the bottom seal tab 28 at a third adhesion strength $S_3$. In one embodiment, the top seal tab 38 may match the shape of the bottom seal tab 28 to ease adhesion of the top seal tab 38 to the bottom seal tab 28.

In one or more embodiments, the top opening tab 36 is positioned substantially opposite the bottom seal tab 28 and the top seal tab 38 along the sealing lip 12. This arrangement allows the top film 30 to be removed from the bottom perforated film 20 by pulling on the top opening tab 36 and then, upon reaching the opposite side of the container 1, a continued peeling force pulls on the top seal tab 38 and the bottom seal tab 28 adhered together at the third adhesion strength and removes the bottom perforated film 20. In further embodiments, the top opening tab 36 is simply askew (i.e., spaced apart but not positioned opposite one another) of the top seal tab 38 and the bottom seal tab 28.

In further embodiments, the bottom perforated film 20 being adhered to the sealing lip 12 and the top film 30 being adhered to the bottom perforated film 20 hermetically seals the container body 10 from an outside environment.

As previously indicated and depicted in FIG. 1, the top film 30, the bottom perforated film 20, and the container body 10 are adhered together at various adhesion strengths. In one or more embodiments, the first adhesion strength $S_1$ is greater than the second adhesion strength $S_2$. Referring to FIGS. 1 and 5B, the first adhesion strength $S_1$ being greater than the second adhesion strength $S_2$ allows the top film 30 to be removed from the bottom perforated film 20 at the opening end 16 while the adhesion of the bottom perforated film 20 to the container body 10 remains intact. In one or more further embodiments, the third adhesion strength $S_3$ is greater than the first adhesion strength $S_1$ which is greater than the second adhesion strength $S_2$. Referring to FIGS. 1 and 5C, the third adhesion strength $S_3$ being greater than the first adhesion strength $S_1$, which in turn is greater than the second adhesion strength $S_2$, allows the top film 30 to be removed from the entirety of the bottom perforated film 20 with the exception of the region where the top seal tab 38 is adhered to the bottom seal tab 28, while the adhesion of the bottom perforated film 20 to the container body 10 remains intact. The third adhesion strength $S_3$ being greater than the first adhesion strength $S_1$ allows the connection between top seal tab 38 and the bottom seal tab 28 to remain intact, while the connection between the bottom perforated film 20 and the container body 10 splits when a peeling force is applied. As such, upon application of pull force to the top opening tab 36, the top film 30 is peelable relative to the bottom perforated film 20 at the opening end 16 and the top film 30 is peelable in conjunction with the bottom perforated film 20 relative to the container body 10 at the seal end 14.

Figure 5A:
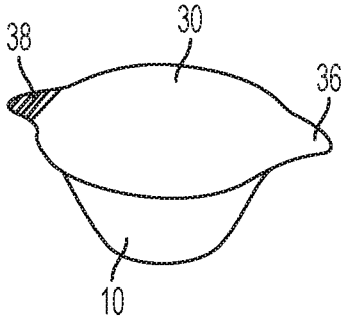
FIG. 5A is a perspective view of a container according to one or more embodiments of the present disclosure.
Figure 5B:
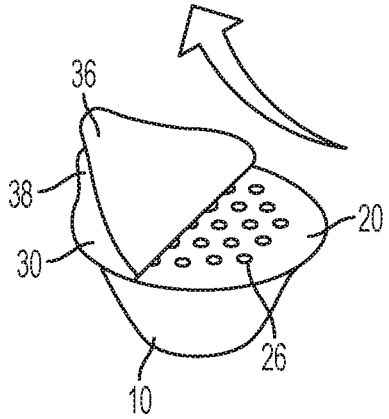
FIG. 5B is a perspective view of a container with a top layer partially removed according to one or more embodiments of the present disclosure.
Figure 5C:
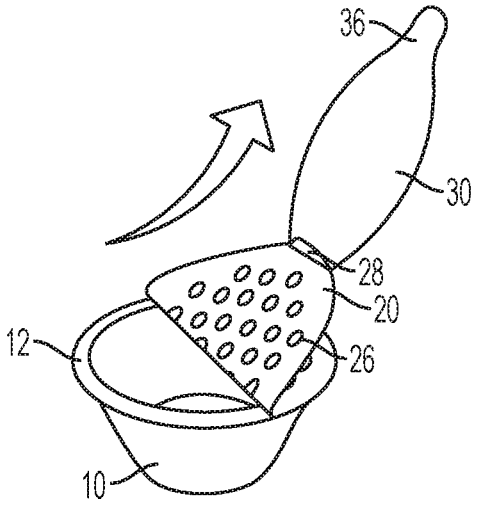
FIG. 5C is a perspective view of a container with a top layer removed and a bottom perforated layer partially removed according to one or more embodiments of the present disclosure.

With reference to FIGS. 5A, 5B, and 5C, this staged peeling of the films of the container 1 may be seen. The top film 30 may be peeled away from the bottom perforated film 20 to expose the perforations 26 in the bottom perforated film 20. In one or more embodiments, the top seal tab 38 and the bottom seal tab 28 are adhered together; this adhesion is depicted with the hatched region of FIG. 5A. As the pull force is continually administered to the top opening tab 36 of the top film 30, the force is transferred through the adhered top seal tab 38 and bottom seal tab 28, and the bottom perforated film 20 is peeled away from the container body 10. In operation, the top film 30 may be peeled away from the bottom perforated film 20 until the top seal tab 38 and the bottom seal tab 28 are reached. Then fluid may be drained from the container 1 through the perforations 26 while retaining solids within the container 1 behind the bottom perforated film 20. Subsequent to draining the fluids, the pull force is re-administered to the top opening tab 36 of the top film 30 or directly to the top seal tab 38 and the bottom seal tab 28 to remove the bottom perforated film 20 from the container body 10. Removal of the bottom perforated film 20 from the container body 10 allows the retained solids to be removed.

Figure 6:
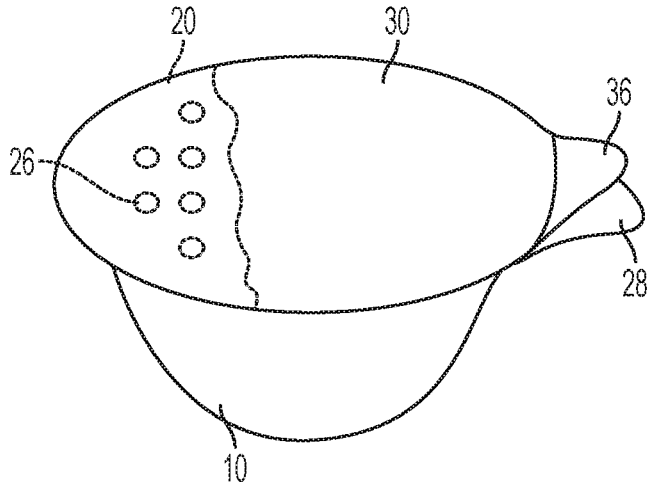
FIG. 6 is a perspective view of a container with a top opening tab and a bottom seal tab in alignment according to one or more embodiments of the present disclosure.
Figure 7:
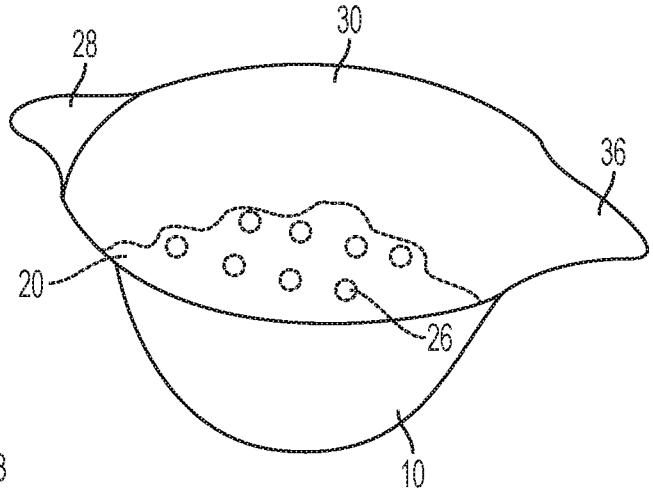
FIG. 7 is a perspective view of a container with a top opening tab and a bottom seal tab in positioned substantially opposite the top opening tab according to one or more embodiments of the present disclosure.
Figure 8:
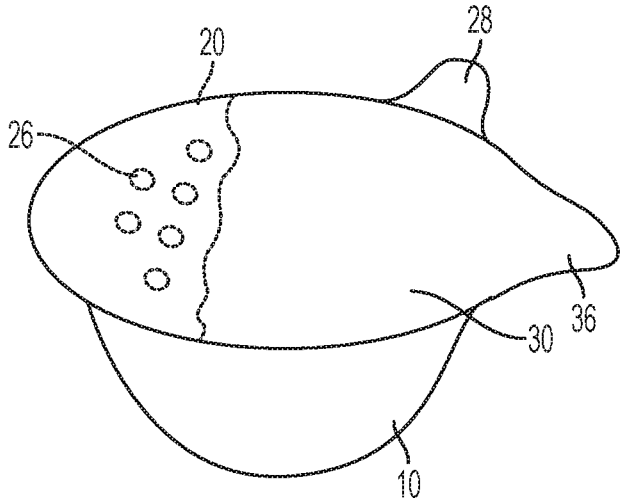
FIG. 8 is a perspective view of a container with a top opening tab and a bottom seal tab positioned askew according to one or more embodiments of the present disclosure.

In further embodiments, the top film 30 may be completely removed from the bottom perforated film 20. Subsequently, the bottom perforated film 20 may be independently removed from the container body 10 after draining of liquid from the container 1 through the perforations 26 of the bottom perforated film 20. With reference to FIGS. 6, 7, and 8, various embodiments of the container 1 configured to fully remove the top film 30 are disclosed. In one or more embodiments, as shown in FIG. 6, the top opening tab 36 is positioned in alignment with the bottom seal tab 28 along the sealing lip 12. In further embodiments, as shown in FIG. 7, the top opening tab 36 is positioned substantially opposite the bottom seal tab 28 along the sealing lip 12. In one or more additional embodiments, as shown in FIG. 8, the top opening tab 36 is positioned askew of the bottom seal tab 28 along the sealing lip 12.

In one or more embodiments, the top film 30 may comprises indicia. Non-limiting examples of the indicia include printing to indicate the contents of the container 1, instructions for opening the container 1, or marketing slogans and graphics.

In one embodiment, the adhesion of the bottom perforated film 20 to the container body 10 and the top film 30 to the bottom perforated film 20 is achieved via a peelable seal. Peelable seals are heat sealable and peelable. As used herein, "peelable" refers to the ability to separate two materials without compromising the integrity of either of the two. In the case of the container 1, this means the top film 30 may be separated from the bottom perforated film 20 and the bottom perforated film 20 may be separated from the sealing lip 12 of the container body 10 without compromising the integrity of the container body 10, the bottom perforated film 20, or the top film 30.

A peelable seal is generally formed by applying heat to a multilayer film product, with at least one layer comprising a structural film layer (which may also be called a substrate layer or a backing layer) and a separate layer forming a sealant layer. Application of the heat causes heat to transfer through the structural layer(s) and melt and fuse the sealant layer to form a seal. As such, while the sealant layer is melted to form a seal, the structural layer or layers does not melt. Subsequently, the multilayer film product is cooled to room temperature and the sealant layer solidifies to form the completed seal.

The force required to pull a seal apart is called the seal strength or adhesion strength. The adhesion strength can be measured in accordance with ASTM F88-94 (100 mm/min pull speed and clamped 30 mm from seal), for example. In one or more embodiments the third adhesion strength is more than 5 N/15 mm (1.9 lb/in) and the second adhesion strength and the first adhesion strength are each less than 5 N/15 mm (1.9 lb/in). In further embodiments, the third adhesion strength is more than 10 N/15 mm (3.8 lb/in) and the second adhesion strength and the first adhesion strength are each less than 10 N/15 mm (3.8 lb/in). In yet further embodiments, the third adhesion strength is more than 15 N/15 mm (5.7 lb/in) and the first adhesion strength is less than 10 N/15 mm (3.8 lb/in) and the second adhesion strength is less than 5 N/15 mm (1.9 lb/in). The adhesion strength varies depending on the material of the sealant layer as well as the temperature, dwell time, and pressure applied during seal formation.

The adhesion strength may be adjusted by adjusting the temperature, pressure, or dwell time of a fusing nip configured to form the seals in the desired locations. For example, increasing the pressure applied by the fusing nip during a sealing operation generally results in a seal with an increased adhesion strength. Similarly, increasing the temperature of the fusing nip also generally results in an increased adhesion strength until such an elevated temperature is reached that the integrity of the film structure is damaged. For example, a peelable seal may be expected to form with a fusing nib pressure of 3 bars and a temperature in the range of 100 to 130° C. for a ½ second dwell time, whereas a lock-up (or non-peelable) seal may be expected to form with a fusing nip pressure of 5 bars and a temperature in excess of 150° C. for a ½ second dwell time. The particular materials and structure of the films determine the specific seal strength profile for varying temperatures and/or pressures. Besides temperature and pressure, the sealing bar geometry may influence seal strength. A flat sealing bar, in general, tends to promote peelability. Conversely, a serrated or non-flat sealing bar tends to promote a lock-up or non-peelable seal. It should be appreciated that each parameter may be varied in conjunction or separately to promote the desired sealing behavior and seal strength. For example low temperature, low pressure, and flat sealing bars will produce differing seal characteristics than high temperature, high pressure, and serrated sealing bars, which will both produce differing seal characteristics than very high temperature, low pressure, and flat bars.

The sealant layer of peelable seals are generally made from one or more polymeric resins. The resulting characteristics of the peelable film and the sealant layer depend largely upon the type of the resins used to form the multilayer film. U.S. Pat. No. 7,863,383, incorporated by reference herein in its entirety, discloses a variety of heat sealable and peelable seals. Other peelable seals may be utilized in adhering the bottom perforated film 20 to the container body 10 and the top film 30 to the bottom perforated film 20. While the first sealant layer 22 and the second sealant layer 32 form the peelable seals, the first substrate layer 24 and the second substrate layer 34 may provide other desirable characteristics to the bottom perforated film 20 and the top film 30, respectively. The first substrate layer 24 and the second substrate layer 34 may provide tearing or stretching strength, oxygen barrier properties, opacity, or other desirable material properties to the bottom perforated film 20 and the top film 30.

In one or more embodiments, the top film 30, the bottom perforated film 20 or both may comprise polyolefins, polystyrenes, or combinations thereof. These polyolefins may include, but are not limited to, polyolefin plastics, polyolefin elastomers, polyolefin plastomers, or combinations thereof. In one or more embodiments, the first sealant layer 22, the second sealant layer 32, or both may comprise a blend of a propylene based plastomer or elastomer, and at least one of a polyethylene or a polystyrene based polymer. In further embodiments, the first sealant layer 22, the second sealant layer 32, or both may comprise ethylene vinyl acetate (EVA) and ethylene methyl acrylate (EMA) copolymers, polybutylene mixed with an EVA polymer, and ionomers, such as SURLYN® (E. I. du Pont de Nemours and Company), mixed with EVA. Suitable commercial products for use as the first sealant layer 22 and the second sealant layer 32 of the bottom perforated film 20 and the top film 30 respectively may include the SEALUTION™ product line of peel polymers from The Dow Chemical Company (Midland, Mich.). These SEALUTION™ products may include but are not limited to SEALUTION™140, SEALUTION™220, or SEALUTION™230. The first substrate layer 24 and/or the second substrate layer 34 may include polyolefins, for example and not by way of limitation, polyethylene and polypropylene.

The container body 10, the bottom perforated film 20, and/or the top film 30 may also contain various additional additives. Examples of such additives include antioxidants, ultraviolet light stabilizers, thermal stabilizers, slip agents, antiblock pigments or colorants, processing aids (such as fluoropolymers), crosslinking catalyst, flame retardants, fillers, foaming agents, and others generally known in the art.

It is contemplated that the container 1 may be formed and sealed in conformity with existing processes. Specifically, the perforated bottom film 20 may be sealed to the container body 10 using a first seal-bar unit on a tray sealing packaging machine and then the top film 30 may be sealed to the perforated bottom film 20 using a second seal-bar unit on a tray sealing packaging machine. As previously indicated, the temperature, dwell time, and pressure applied by the individual seal-bars may be adjusted to achieve the desired adhesion strength for each seal. Additionally, the second seal-bar unit may include areas of differing temperature to achieve a seal at the second adhesion strength S2 in alignment with the sealing lip 12 but at the third adhesion strength S3 in alignment with the top seal tab 38 and the bottom seal tab 28.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present disclosure.

It will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these aspects.

The invention claimed is:

1. A container comprising:

a container body having a sealing lip, the sealing lip comprising an opening end and a seal end spaced from the opening end;

a bottom perforated film comprising a first sealant layer and a first substrate layer, the first sealant layer being adhered to the sealing lip at a first adhesion strength;

a top film adhered to the bottom perforated film, and comprising a second sealant layer and a second substrate layer, wherein the top film adheres to the bottom perforated film at a second adhesion strength at one or more locations not in vertical alignment with the seal end and only at locations in vertical alignment with the sealing lip, and wherein the top film adheres to the bottom perforated film at a third adhesion strength at a location in vertical alignment with the seal end;

wherein the third adhesion strength is greater than the first adhesion strength which is greater than the second adhesion strength, such that, upon application of a pull force, the top film is peelable relative to the bottom perforated film at the opening end and the top film is peelable with the bottom perforated film relative to the container body at the seal end.

2. The container of claim 1, wherein the bottom perforated film comprises a bottom seal tab extending beyond the sealing lip at the seal end.

3. The container of claim 1, wherein the application of the pull force on the bottom seal tab is operable to peel the bottom perforated film relative to the container body.

4. The container of claim 1, wherein the top film comprises a top seal tab in vertical alignment with the bottom seal tab.

5. The container of claim 1, wherein the top film comprises a top opening tab extending beyond the sealing lip at the opening end, wherein the application of the pull force on the top opening tab is operable to peel the top film relative to the bottom perforated film at the opening end.

6. The container of claim 1, wherein the opening end is positioned substantially opposite the seal end along the sealing lip.

7. The container of claim 1, wherein the first adhesion strength is less than 10N/15 mm when measured according to ASTM F88-94 at a pull speed of 100 mm/minute.

8. The container of claim 1, wherein the second adhesion strength is less than 10N/15 mm when measured according to ASTM F88-94 at a pull speed of 100 mm/minute.

9. The container of claim 1, wherein the top film, the bottom perforated film or both comprise polyolefins, polystyrenes, or combinations thereof.

10. The container of claim 1, wherein the top film, the bottom perforated film or both comprise polyolefin plastics, polyolefin elastomers, polyolefin plastomers, or combinations thereof.

11. The container of claim 1, wherein the first sealant layer, the second sealant layer, or both comprises a propylene based plastomer or elastomer and at least one of a polyethylene or a polystyrene based polymer, ethylene vinyl acetate and ethylene methyl acrylate copolymers, polybutylene, an ionomer, or combinations thereof.

12. The container of claim 1, wherein the container body comprises one or more polyolefins, polyethylene terephthalate, polystyrene, or combinations thereof.

13. The container of claim 1, wherein the container body comprises polyethylene, polypropylene, or combinations thereof.

14. The container of claim 1, wherein the third adhesion strength is more than 10N/15 mm when measured according to ASTM F88-94 at a pull speed of 100 mm/minute.

15. The container of claim 2, wherein the application of the pull force on the bottom seal tab is operable to peel the bottom perforated film relative to the container body.

16. The container of claim 2, wherein the top film comprises a top seal tab in vertical alignment with the bottom seal tab.

* * * * *